US006138993A

United States Patent [19]

Mitchell, Jr. et al.

[11] Patent Number: 6,138,993

[45] Date of Patent: Oct. 31, 2000

[54] PROTECTION SCREEN FOR CONDENSER UNIT

[76] Inventors: James E. Mitchell, Jr., 7100 E. Chesapeake St.; John H. Mitchell, 7103 E. Marlboro Ave., both of Landover, Md. 20785; Norman E. Logan, 861 52nd St., NE., Washington, D.C. 20013

[21] Appl. No.: 09/148,139

[22] Filed: Sep. 4, 1998

Related U.S. Application Data

[60] Provisional application No. 60/057,640, Sep. 5, 1997.

[51] Int. Cl.[7] ..... E04H 17/14

[52] U.S. Cl. ..... 256/25; 256/27; 256/67

[58] Field of Search ..... 256/24, 25, 26, 256/27, 32, 67, 73, 30, 31, 35, 1, 64; 49/55

[56] References Cited

U.S. PATENT DOCUMENTS

| | | | |
|---|---|---|---|
| 610,555 | 9/1898 | McNamee | 256/73 X |
| 640,700 | 1/1900 | Reece | 256/73 X |
| 1,160,728 | 11/1915 | Liggett | 256/24 |
| 1,210,541 | 1/1917 | Ryker | 256/31 X |
| 1,909,173 | 5/1933 | Gilhool . | |
| 1,951,282 | 3/1934 | Hise et al. | 256/32 X |
| 2,705,990 | 4/1955 | Miller . | |
| 2,709,073 | 5/1955 | Dougherty | 256/24 |
| 2,723,107 | 11/1955 | Parker | 256/24 |
| 2,892,424 | 6/1959 | Mondi . | |
| 3,320,996 | 5/1967 | Singer . | |
| 3,332,667 | 7/1967 | Armstrong | 256/30 X |
| 3,436,889 | 4/1969 | Jessee . | |
| 3,770,245 | 11/1973 | Murdock | 256/24 |
| 4,677,791 | 7/1987 | Larson et al. | 49/55 X |
| 4,787,174 | 11/1988 | Brown | 49/55 |
| 5,097,678 | 3/1992 | Aubuchon . | |
| 5,131,463 | 7/1992 | Zimmerli et al. . | |
| 5,156,662 | 10/1992 | Downing et al. . | |
| 5,307,849 | 5/1994 | Nelson . | |
| 5,312,467 | 5/1994 | Wolfe . | |

*Primary Examiner*—Harry C. Kim
*Attorney, Agent, or Firm*—Jones, Tullar & Cooper, PC

[57] ABSTRACT

A protection screen for a condenser unit of an air conditioning or heat pump system utilizes a plurality of screen panels to form a protective enclosure about the periphery of the condenser unit. The protection screen is self-supporting and is spaced a sufficient distance from the condenser unit to provide an adequate air gap. The protection screen prevents ingress of clogging particulate matter into the heat exchanger portion of the condenser unit.

6 Claims, 3 Drawing Sheets

PROTECTION SCREEN FOR CONDENSER UNIT

CROSS-REFERENCE TO RELATED APPLICATION

The subject patent application claims the benefit of U.S. Provisional Application No. 60/057,640, which was filed on Sep. 5, 1997. The disclosure of that provisional patent application is hereby incorporated herein by reference.

FIELD OF THE INVENTION

The present invention is directed generally to a protection screen for a condenser unit. More particularly, the present invention is directed to a protection screen for an outside condenser unit of an air conditioner or heat pump. Most specifically, the present invention is directed to a free standing protection screen for utilization with an outside condenser unit of a HVAC system.

The protection screen is adjustably sized to form a protective enclosure that is spaced from the outside condenser unit of an air conditioner or heat pump. An air gap of sufficient size so as not to inhibit the operating efficiency of the condenser unit is left between the protection screen and the condenser. The protection screen prevents grass clippings, leaves and other debris from clogging the heat exchanger fins of the condenser. It also serves as a protective barrier and shields the condenser from physical damage from lawn mowers, children playing, dogs urinating and other potential damage. The protection screen will extend the life of the condenser while not interfering with the operation of the condenser or its servicing.

DESCRIPTION OF THE PRIOR ART

A large number of homes and other buildings are cooled by central air conditioning systems and a sizable number of homes and other buildings are both heated and cooled by heat pumps. The number of such systems being installed, and in use continues to increase. Each of these air conditioning or heat pump systems requires an inside air handler and also requires an outside condenser unit. In many larger structures, there are provided multi-zone heating and air conditioning systems. Each zone's system requires a separate outside condenser.

The primary function of the outside condenser unit is to give up heat in the case of an air conditioning system or a heat pump acting as an air conditioner, or to take on heat, in the case of a heat pump acting as a heating system. This giving up or taking on of heat is accomplished through the phase change of a suitable refrigerant fluid, in a cycle that is well known in the art. One of the most crucial elements required for the phase change of the refrigerant fluid is the provision of a large heat exchange surface. In the typical air conditioning or heat pump condenser, this heat exchange surface is in the form of a large area of finned tubing which is situated about the outer periphery of the condenser. A centrally located fan pulls ambient air through the condenser to accomplish the efficient giving up or taking on heat from the ambient air. Clearly, unrestricted air flow through the heat exchanger assembly of the condenser is required for efficient operation of the unit.

The outside condenser unit for an air conditioner or a heat pump is typically set on a concrete pad at the rear of the home or other building and is surrounded on at least three sides by lawn, landscaping, or other vegetation. Every time the lawn is mowed, grass clippings will be blown into the heat exchanger fins. Dead leaves and other air-borne particles also find their way into the heat exchanger portion of the condenser. These grass clippings, leaves, sand, dirt and other debris severely limit the air flow through the heat exchanger portion of the condenser. With reduced air flow, the condenser has to work harder and thus has a shorter life and increases the owner's energy bills.

Condenser units are also subjected to collisions with lawn mowers, children and their toys and other objects. These collisions are apt to deform the heat exchanger fins and such damage reduces the efficiency of the unit and increases the owner's costs. Condensers often also suffer the corrosive effects of dog urine since the condensers present an attractive target for such activities. Again, the result is a shortened unit life and an increased cost for the owner.

If the condenser is part of a heat pump, the potential for clogging of the heat exchanger becomes a year round problem. In winter climates, a build-up of snow and ice can easily clog the air flow through the condenser. Blowing snow will render a condenser unit inoperative within a short period of time. Even though the condenser goes through periodic defrost cycles, these may not be sufficient to keep the unit from becoming clogged by blowing snow.

An inefficient condenser requires longer periods of operation to accomplish the same result as an efficient condenser. Since the vast majority of these units are electrically operated, any inefficiency in their operation gives rise to increased utility bills. These bills obviously increase the owner's cost. The inefficiency of the unit requires the use of more electricity, which in turn requires the generation of more electricity with a resultant increase in pollution and a more rapid useage of natural resources.

One attempted prior solution to this problem is the provision of an exterior filter or screen which can be secured onto the air conditioning compressor unit. Such a device is shown in U.S. Pat. No. 5,156,662 to Downing. The intent of this device is to cover the air intake of the unit with a filter or screen. The screen is attached to the unit by flexible straps and depends on the unit for its support. Its primary limitation is that since it is physically attached to the unit and overlies the unit, there is no possible air gap or air space between the screen and the unit. If the screen or filter becomes clogged, the air intake to the unit is effectively also clogged.

It will be seen that a need exists for a protection screen or filter that overcomes the limitations of the prior art. The protection screen for a condenser unit in accordance with the present invention overcomes these limitations and is a significant improvement over the prior art.

SUMMARY OF THE INVENTION

It is an object of the present invention to provide a protection screen for a condenser unit.

Another object of the present invention is to provide a protection screen for an outside condenser unit of a heat pump or air conditioner.

A further object of the present invention is to provide a free standing protection screen for utilization with an outside condenser unit of a HVAC system.

Still another object of the present invention is to provide a protection screen that is adjustable in size and which is useable with a variety of different condenser units.

Yet a further object of the present invention is to provide a protection unit that is easily installed and maintained.

As will be discussed in detail in the description of the preferred embodiment which is presented subsequently, the protection screen for a condenser unit of a HVAC system in accordance with the present invention utilizes a plurality of screen panels to prevent the condenser unit from becoming clogged, obstructed or damaged. One or more of these screen panels are formed by telescopingly adjustable screen sections so that the overall size of the protection screen can be varied. In a typical installation, the protection screen is installed around at least three sides of the outside condenser unit and is spaced from the outer surfaces of the condenser unit to provide an air gap of sufficient width so that air flow to the condenser unit will not be compromised, even if the protection screen itself becomes clogged with debris.

The protection screen in accordance with the present invention will effectively prevent grass clippings, leaves, snow and other air-borne particulate matter from coming close to the condenser unit. This allows unobstructed air flow through the condenser with a resultant continued efficient operation of the unit. Since the unit will not become clogged and will continue to operate at peak efficiency, the owner's energy bills will be as low as possible. Additionally, since less power is required by efficient operation, the demands placed on the utility industry will not be as great. This will result in reduced air pollution and the less rapid depletion of natural resources.

The protection screen for a condenser unit of a HVAC system in accordance with the present invention provides a physical barrier between the condenser unit and potentially damaging objects such as lawn mowers, playing children and their toys, domestic pets and the like. The protection screen will shield the condenser unit from these sources of damage. If the protection screen becomes damaged or compromised, it can be replaced at a far lesser cost than would be required to replace the condenser unit itself. Since the protection screen is spaced from the condenser unit, the unit itself will not be damaged if the protection screen is struck.

If the condenser unit's heat exchange assembly becomes clogged, the services of a skilled technician are required to disassemble the unit and to clear it. In marked contract, if the protection screen of the present invention becomes clogged, it can be quickly and easily be cleaned by the owner using a hose to wash off the accumulated debris. If the protection screen becomes damaged by collisions with back yard objects, it can be replaced. Since the protection screen is typically constructed from several joinable sections, it is often possible to replace only one section.

In contract with prior devices, the protection screen of the present invention is spaced from the condenser unit and may be free-standing. Obstruction of the protection screen will not obstruct the condenser unit. Cleaning of the protection unit will not require taking the condenser unit out of service. Additionally, since the protection unit is adjustable in size, it will readily adapt to various sizes and shapes of outside condenser units supplied by various manufacturers.

The protection screen for a condenser unit in accordance with the present invention overcomes the limitations of the prior art. It is a substantial advance in the art.

BRIEF DESCRIPTION OF THE DRAWINGS

While the novel features of the protection screen for a condenser unit in accordance with the present invention are sent forth with particularity in the appended claims, a fill and complete understanding of the invention may be had by referring to the detailed description of the preferred embodiment which is presented subsequently, and as illustrated in the accompanying drawings, in which:

DESCRIPTION OF THE PREFERRED EMBODIMENTS

Figure 1:
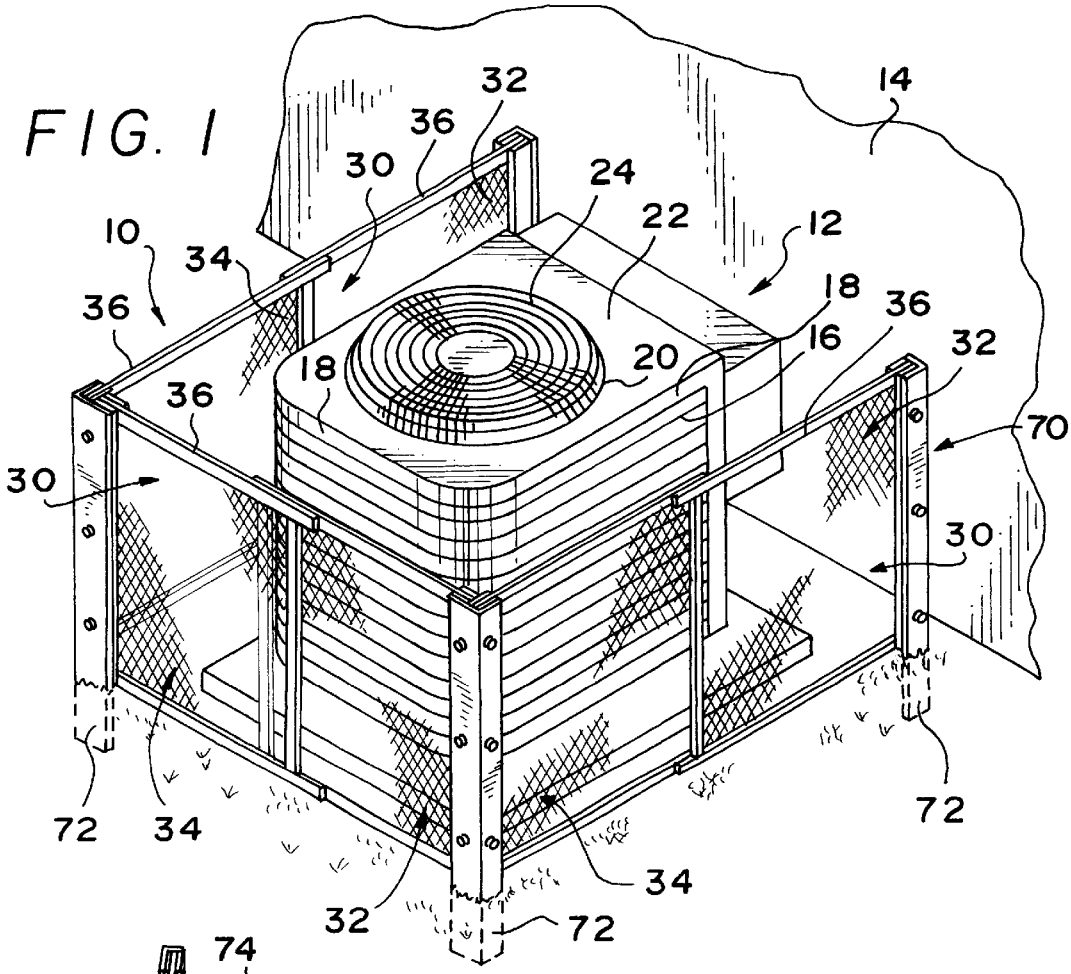
FIG. 1 is a perspective view of a protection screen for a condenser unit in accordance with the present invention.
Figure 2:
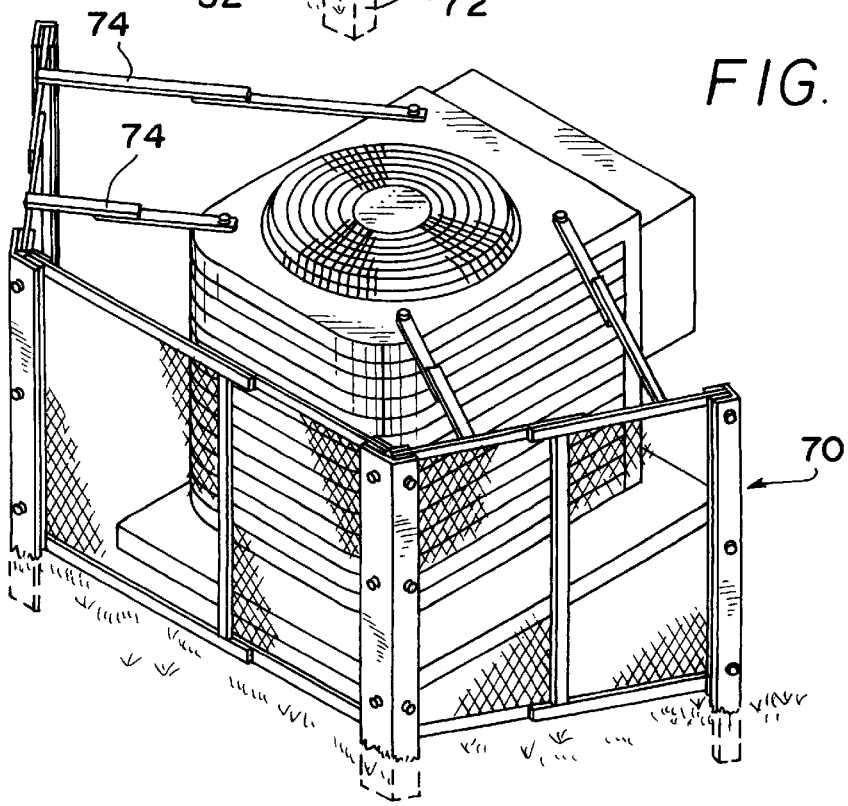
FIG. 2 is a view generally similar to FIG. 1 and showing the protection screen attached to, and spaced from the condenser unit.

Referring initially to FIG. 1, there may seem generally at 10 a first preferred embodiment of a protection screen for a condenser unit in accordance with the present invention. As is shown in FIG. 1, and also in FIG. 2, the protection unit 10 is intended to at least partically surround and to protect a condenser unit which is depicted generally at 12. It will be understood that condenser unit 12 is intended to be a representative depiction of a wide variety of condenser units which form the outside component of a typical air conditioner or heat pump system. Typically, the condenser unit 12 is located outside and adjacent to an exterior wall 14 of a residence or other building. The typical condenser unit 12 includes a fan (not shown) that pulls air in through slots or similar apertures 16 in the side walls 18 of the condenser unit 12. A central air discharge opening 20 in a top surface 22 of the condenser unit 12 is covered by a protective grid 24. As will be understood by one of skill in the art, air is pulled into the condenser unit 12 through the slots or apertures 16 in the side walls 18 and is discharged through the central air discharge opening 20 by the fan. As the air passes from the air inlet slots 16 to the air discharge opening 20, it passes through a network of heat exchange tubings which are not specifically shown in the drawings. The structure and operation of the condenser unit is well-known to those of skill in the art and forms no part of the present invention. As will also be appreciated by those of skill in the art, the overall shape of the condenser unit 12, as depicted in FIGS. 1 and 2 is meant to be exemplary of a wide range of shapes and sizes that these condenser units take. Typically these units are square, rectangular or cylindrical but the protection screen generally at 10 is equally useable with any and all such unit shapes.

Figure 4:
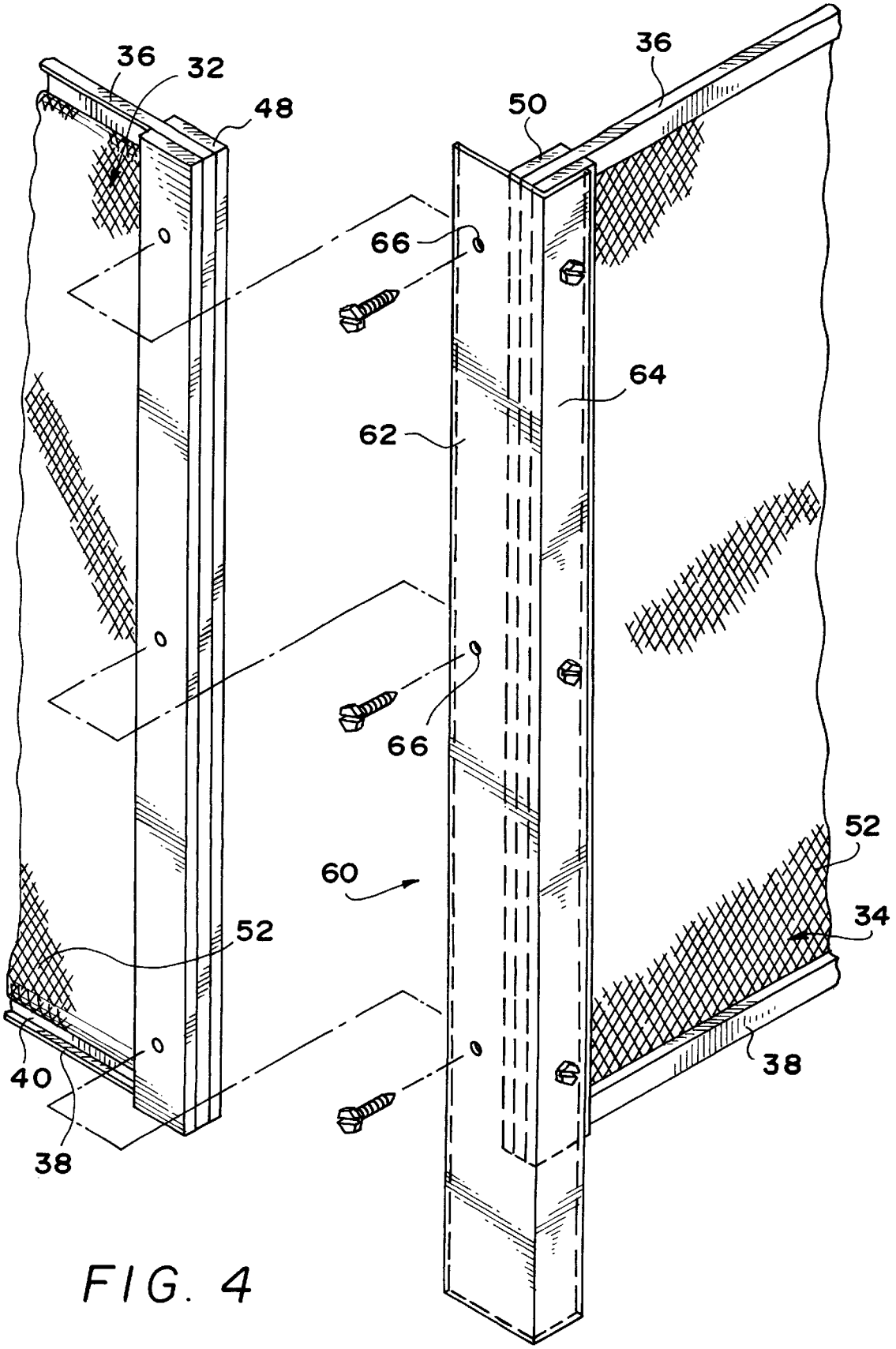
FIG. 4 is an enlarged view of a portion of the protection screen shown in FIG. 3.

Referring again primarily to FIG. 1, the protection screen 10 in accordance with the present invention is comprised of a plurality of individual screen panels 30. Each screen panel 30 is preferably formed by at least two telescopingly connected screen sections 32 and 34 with each such screen section 32 or 34 having a top screen section rail 36, and a bottom screen section rail 38. The top screen section rails 36 of the two screen sections 32 and 34, that make up each screen panel 30, telescopingly interfit. In a similar manner, the two bottom screen section rails 38 of the two screen sections 32 and 34 that make up each screen panel 30 also telescopingly interfit. Any suitable telescoping structure can be used for the mating screen section rails. In one configuration, each screen section rail 36 or 38 on one screen section 32 or 34 may be in the form of a channel 40, as seen most clearly in FIG. 4, and the mating rail 36 or 38 on the second screen section 34 or 32 may have a tongue 42 which fits into the channel 40. Other suitable telescoping shapes are also useable.

The individual screen sections 32 and 34 depicted in FIGS. 1–4 are each generally rectangular and are defined by the top and bottom screen section rails 36 and 38 and by inboard end rails 44 and 46, respectively. Outboard end rails 48 and 50, respectively are also provided for the screen sections 32 and 34. As seen most clearly in FIG. 4, the outboard end rails 48 and 50 are double thickness rails that sandwich the ends of the top and bottom screen section rails 36 and 38, respectively.

In the protection screen depicted in FIGS. 1–4, each of the screen sections 32 and 34 which make up a screen panel 30 are formed using a fine mesh wire screen 52 that is held in place by each screen section's top and bottom screen section rails 36 and 38 and by each sections's inboard end rails 44 and 46 and outboard end rails 48 and 50. The wire screen 52 can be secured to the various rails by crimping of the rails, by spot welding, or by any other suitable methods of manufacture. Additionally, while the mesh screen and the various rails for each of the screen sections 32 and 34 has been described as being made of metal, it will be understood that suitable alternative materials, such as plastics and the like could also be used to make each of the screen sections. Further, while each screen panel 30 has been described hereinabove as having two screen sections 32 and 34, it will be understood that each screen panel 30 could be a single, non-adjustable section or could be made up of three or more screen sections. The overall size of each panel will be selected so that it will cooperate with a large number of commercially available condenser units. In a preferred embodiment, the protection unit 10 in accordance with the present invention will be sized so that it can properly shield and protect a condenser unit 12 up to 48" high and 48" wide by 48" deep.

Returning to FIG. 1, three screen panels 30 can be joined together to form a three sided protection unit 10 that will shield and protect a condenser unit 12. Although the three screen panels 30 are the same, in the configuration shown in FIG. 1 one panel 30 is used as a front panel while two others are used as side panels. The front screen panel 30 is the one oriented generally parallel to the building wall 14 while the two side screen panels 30 are generally perpendicular to the wall 14. The outboard end rails 48 and 50 of the screen sections 32 and 34 of the front screen panel 30 are connected to the outboard end rails 50 of the screen panels 34 of the two side screens 30 by connector channels 60. Each connector channel 60 has a front face 62 and a side face 64. These faces 62 and 64 are each provided with vertically spaced face apertures 66. These apertures 66 receive suitable fasteners, such as sheet metal screws 68 that pass through the apertures 66 and into the outboard end rails 48 and 50 of the associated front and side panels 30, all as seen most clearly in FIGS. 3 and 4.

Figure 3:
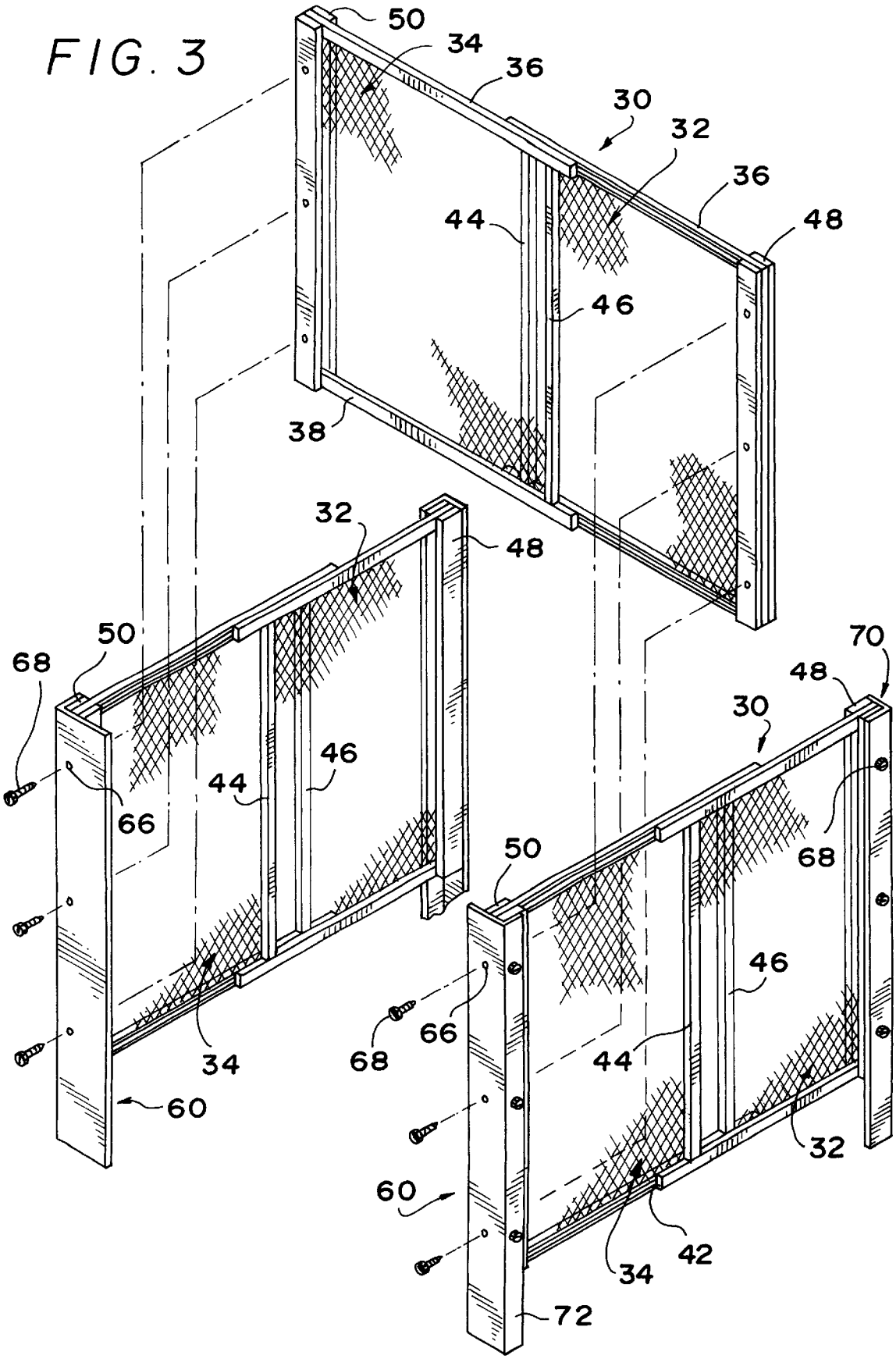
FIG. 3, as an exploded perspective view of the protection screen of the present invention.

As may also be seen in FIGS. 1, 2 and 3, the ends of the side panels 30 opposite to the ends connected to the front panel 30 by the connector channels 60 are joined to end channels 70. Each end channel 70 is attached to its associated outboard end rail 48 of screen sections 32 by sheet metal screws 68.

Each of the connector channels 60 and the end channels 70 has an overall height greater than that of the screen panel 30 or screen section 32 or 34 to which it is connected. As seen in FIGS. 1 and 2, this provides a channel foot 72 that is inserted into the ground when the protection unit 10 is installed to shield and protect its associated condenser unit 12. The channel feet 72 can be chisel-shaped, can be barbed, or can be otherwise structured to facilitate insertion into the ground.

In the protection unit 10 depicted in FIG. 1, the three screen panels 30 are oriented at generally 90° to each other and are not connected to the condenser unit 12. In the protection unit 10 depicted in FIG. 2, the three screen panels 30 are joined to each other by the two connector channels 60 whose front and side faces 62 and 64 join each other at an obtuse angle. The resultant protection unit 10 is not rectangular but is somewhat trapizoidal. It is within the scope of the present invention to provide suitably angled connector channels 60 to accommodate various shapes of condenser units 12. It is also possible to provide connector struts 74 of telescoping lengths that can extend between the condenser unit 12 and the screen panels 30. If such connector struts 74 are used to support the protection unit 10 spaced from the condenser unit 12, the channel feet 72 may or may not be used. If the protection unit 10 is provided as an adjunct to a new condenser unit 12 and is shipped with it from the factory, the channel feet 72 may be dispensed with.

The protection screen depicted in FIGS. 1 and 2 is shown as a three-sided structure without a top. If desired, a top screen panel, which is not specifically shown in the drawings, can be provided. The top screen panel can also be telescoping in size and can be made of several cooperating top screen sections. Such a top screen panel will be attached to the front and side screen panels 30 so as to overlie, and to be spaced from, the top surface 22 of the condenser unit 10. Since this top screen panel may be required to support the weight of debris that may temporarily be on it, it will be made of relatively heavy gauge screen wire with a mesh size of at least ¼". A mesh size smaller that ¼" could possibly become obstructed by debris that might temporarily be on the top screen. A similar relatively heavy gauge, large mesh screen wire could also be applied to the outer sides of the three screen panels 30 to provide additional reinforcement, if needed. The top screen panel could be provided with suitable fasteners, such as spring clips or the like, to expedite its attachment to, and removal from the top screen section rails of the screen panels 30. It would also be possible to provide the top screen panel with a convex shape to prevent even the temporary accumulation of debris, such as wet leaves or the like, on the top screen panel.

Regardless of the overall shape of the protection screen 10, it is an essential aspect of the present invention that the protection screen 10 be situated spaced from its associated condenser unit 12 at a sufficient distance to provide an adequate air gap or air circulation space. In use, the protection screen 10 will shield the condenser unit from grass clippings, leaves and the like. These particles will be stopped by the screen 52 and thus will be prevented from clogging the heat exchanger portion of the condenser unit 12. Even if the protection screen 10 becomes covered with leaves, grass clippings and other debris, the spacing between it and the condenser unit 12 will be sufficient to insure adequate, unrestricted air flow to the condenser unit 12. In practice, it has been found that an air gap or air space of at least 6" is to be maintained between the surface of the side walls 18 of the condenser unit 12, the top 22 of the condenser unit 12 and the protection screen 10. Too small a space or air gap can inhibit proper air flow. Too great a space or air gap can allow debris to circumvent the protection screen 10.

In the preceding discussion, the protection screen 10 has been described as comprising three screen panels 30 with each screen panel consisting of two telescopingly connected screen sections 32 and 34. While this is a preferred configuration and has numerous benefits such as size adaptability, ease of packaging, shipping and assembly, a self-supporting capability and the like, it is within the scope of the present invention to provide other structural shapes and configurations for the protection unit. For example, the screen panels could be arcuate and could form a semi-cylinder around the condenser unit 10. Other similar arrangements are also possible. It is also within the scope of the present invention to utilize a variety of fastening or joining assemblies to connect the several screen panels to each other. For example, the front screen panel 30 could be connected to the two side screen panels 30 by suitable hinges. Other connectors, such as hook and loop strips and the like could be used to join the several screen panels 30 in order to form the protection screen 10 of the present invention. A number of such variations are possible while still adhering to the overall concept of the subject invention; i.e. a protection screen that is positionable adjacent to, but spaced from the air intake openings of a condenser unit and thus prevents the ingress of particulate matter into the heat exchanger position of the condenser unit.

While a preferred embodiment of a protection screen for a condenser unit in accordance with the present invention has been set forth fully and completely hereinabove, it will be apparent to one of skill in the art that a number of changes in, for example, the overall size and shape of the condenser unit with which the protection screen can be used, the overall size of the protection screen, the production techniques used to make the screen and the like can be made without departing form the true spirit and scope of the present invention which is accordingly to be limited only by the following claims.

What is claimed is:

1. A condenser protection screen positionable about a condenser unit, said condenser protection screen comprising:

a first screen panel formed by first and second telescopingly connected screen sections, each of said first and second screen sections being formed by a fine mesh screen supported by top and bottom screen section rails and by inboard and outboard screen section end rails, said fine mesh screen being sized to prevent ingress of particulate material into the condenser unit;

a second screen panel, said second screen panel having a second screen panel outboard end rail and a second screen panel inboard end rail and second screen panel top and bottom screen rails, said second screen panel being formed by said fine mesh screen;

a third screen panel, said third screen panel having a third screen panel outboard end rail and a third screen panel inboard end rail and third screen panel top and bottom screen rails, said third screen panel being formed by said fine mesh screen;

first and second connector channels each having a front face, a side face and a channel foot;

means connecting said front face of said first connector channel to said outboard screen section end rail of said first screen section and means connecting said front face of said second connector channel to said outboard screen section end rail of said second screen section; and means connecting said side face of said first connector channel to said inboard end rail of said second screen panel, and means connecting said side face of said second connector channel to said inboard end rail of said third screen panel to form a screen enclosure sized to cooperate with the condenser unit, said first connector channel foot and said second connector channel foot supporting said screen enclosure spaced from the condenser unit a distance sufficient to facilitate unrestricted air flow to the condenser unit.

2. The condenser protection screen of claim 1 wherein said second and third screen panels each include first and second telescopingly connected screen sections.

3. The condenser protection screen of claim 1 further including first and second end channels attached to said outboard end rails of said second and third screen panels, each of said first and second end channels having a channel foot.

4. The condenser protection screen of claim 1 wherein each of said screen panels is generally rectangular.

5. The condenser protection screen of claim 1 further including connector struts secured to selected ones of said screen panels and engageable with the condenser unit.

6. The condenser protection screen of claim 5 wherein each of said connector struts is of adjustable length.

* * * * *